US010497501B2

(12) United States Patent
Chu

(10) Patent No.: US 10,497,501 B2
(45) Date of Patent: Dec. 3, 2019

(54) DOWNHOLE LINEAR SOLENOID ACTUATOR SYSTEM

(71) Applicant: Halliburton Energy Services, Inc., Houston, TX (US)

(72) Inventor: Jianying Chu, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 397 days.

(21) Appl. No.: 15/315,866

(22) PCT Filed: Sep. 15, 2015

(86) PCT No.: PCT/US2015/050194
§ 371 (c)(1),
(2) Date: Dec. 2, 2016

(87) PCT Pub. No.: WO2016/108960
PCT Pub. Date: Jul. 7, 2016

(65) Prior Publication Data

US 2017/0092406 A1 Mar. 30, 2017

(30) Foreign Application Priority Data

Dec. 29, 2014 (WO) ..... PCT/US2014/072577

(51) Int. Cl.
*H01F 7/06* (2006.01)
*E21B 47/18* (2012.01)
*H01F 7/16* (2006.01)

(52) U.S. Cl.
CPC ..... *H01F 7/064* (2013.01); *E21B 47/18* (2013.01); *E21B 47/185* (2013.01); *H01F 7/1607* (2013.01)

(58) Field of Classification Search
CPC .. H01F 7/064; H01F 2007/083; H01F 7/1607; E21B 47/18
See application file for complete search history.

(56) References Cited

U.S. PATENT DOCUMENTS 4,336,564 A * 6/1982 Wisniewski ..... E21B 47/18 361/154
4,531,579 A 7/1985 Larronde et al.
(Continued)

FOREIGN PATENT DOCUMENTS

RU 2325685 C2 5/2006
WO 2003/001547 A1 1/2003
(Continued)

OTHER PUBLICATIONS

International Preliminary Report on Patentability issued in related Application No. PCT/US2015/050194, dated Jul. 13, 2017 (9 pages).
(Continued)

*Primary Examiner* — Ronald W Leja
*Assistant Examiner* — Christopher J Clark
(74) *Attorney, Agent, or Firm* — Jason Sedano; Baker Botts L.L.P.

(57) ABSTRACT

An example apparatus may include a solenoid actuator with a solenoid coil and a corresponding solenoid armature. A plurality of switches may be coupled to the solenoid coil. A controller may be electrically coupled to the plurality of switches, the controller having a processor and a memory device coupled to the processor. The memory device may contain a set of instructions that, when executed by the processor cause the processor to receive a feedback signal corresponding to a condition of at least one of the solenoid coil and the solenoid armature; and generate a control signal to alter the state of at least one of the plurality of switches based, at least in part, on the received feedback signal.

20 Claims, 5 Drawing Sheets

(56) References Cited

U.S. PATENT DOCUMENTS 4,636,934 A * 1/1987 Schwendemann ..... E21B 33/0355 137/624.18
4,689,775 A * 8/1987 Scherbatskoy ..... E21B 47/185 175/48
5,942,892 A * 8/1999 Li ..... H01F 7/1844 137/554
6,175,484 B1 1/2001 Caruthers et al.
6,920,085 B2 * 7/2005 Finke ..... E21B 47/185 166/373
7,612,978 B2 11/2009 Bergstrom et al.
2004/0024568 A1 2/2004 Eryurek et al.
2004/0025949 A1 * 2/2004 Wygnaski ..... F16K 31/0682 137/624.18
2008/0204176 A1 * 8/2008 Sriraksat ..... H01F 7/122 335/234
2009/0107682 A1 4/2009 Davis
2010/0127807 A1 5/2010 Hammond
2010/0148755 A1 * 6/2010 Liu ..... G01D 5/2013 324/123 R
2010/0198538 A1 * 8/2010 Kurmaniak ..... F16D 27/115 702/64
2013/0080063 A1 3/2013 Pillai et al.
2013/0248002 A1 * 9/2013 Haller ..... F16K 31/0675 137/14
2015/0021441 A1 * 1/2015 Matsui ..... B64C 13/42 244/175
2016/0146001 A1 * 5/2016 Chu ..... E21B 47/18 367/83
2017/0045379 A1 * 2/2017 Mitzel ..... G01D 5/147

FOREIGN PATENT DOCUMENTS

WO 2009/138849 A1 11/2009
WO WO-2015065419 A1 * 5/2015 ..... E21B 47/18

OTHER PUBLICATIONS

International Preliminary Report on Patentability issued in related Application No. PCT/US2014/072577, dated Jul. 13, 2017 (9 pages).
Search report issued in related Russian application No. 2017113115 dated May 31, 2018 ( 2 pages).
Examiner's Letter issued in related Canadian application No. 2,966,784, dated Oct. 2, 2018, 3 pages.
International Search Report and Written Opinion issued in related PCT Application No. PCT/US2014/072577 dated Aug. 31, 2015, 16 pages.
International Search Report and Written Opinion issued in related PCT Application No. PCT/US2015/050194 dated Dec. 30, 2015, 16 pages.
Office Action issued in related Canadian Patent Application No. 2966866 dated Sep. 16, 2019, 4 pages.

* cited by examiner

DOWNHOLE LINEAR SOLENOID ACTUATOR SYSTEM

CROSS-REFERENCE TO RELATED APPLICATION

The present application claims priority to PCT Application No PCT/US2014/072577, entitled "Downhole Solenoid Actuator Drive System" filed on Dec. 29, 2014, and PCT Application No. PCT/US2015/050194, entitled "Downhole Linear Solenoid Actuator System" filed on Sep. 15, 2015, both of which are incorporated by reference herein in their entirety.

BACKGROUND

Hydrocarbons, such as oil and gas, are commonly obtained from subterranean formations that may be located onshore or offshore. The development of subterranean operations and the processes involved in removing hydrocarbons from a subterranean formation are complex. Typically, subterranean operations involve a number of different steps such as, for example, drilling a wellbore at a desired well site, treating the wellbore to optimize production of hydrocarbons, and performing the necessary steps to produce and process the hydrocarbons from the subterranean formation.

Linear actuators may be used in subterranean operations to perform various functions, including the control of valves and mechanical elements. In one application, a linear actuator is used to control a hydraulic value in a downhole telemetry system. The hydraulic valve may alter a flow path of a drilling fluid circulating through the wellbore, which causes pressure fluctuations into which downhole information can be encoded and transmitted to the surface. In such applications, the linear actuator operates in harsh environments where temperature, humidity, shock and vibration make the actuator design challenging.

Linear solenoid actuators, one type of linear actuator used in downhole telemetry systems, are generally rugged with respect to withstanding the downhole conditions, but are typically subject to mechanical breakdown in the mechanism used to return the actuator to it original position, or to material fatigue caused by impact forces when then actuator returns to its original position. Additionally, typical linear solenoid actuators are energy inefficient and suffer from heat generation problems due in part to the energy inefficiency.

FIGURES

Some specific exemplary embodiments of the disclosure may be understood by referring, in part, to the following description and the accompanying drawings.

Figure 1:
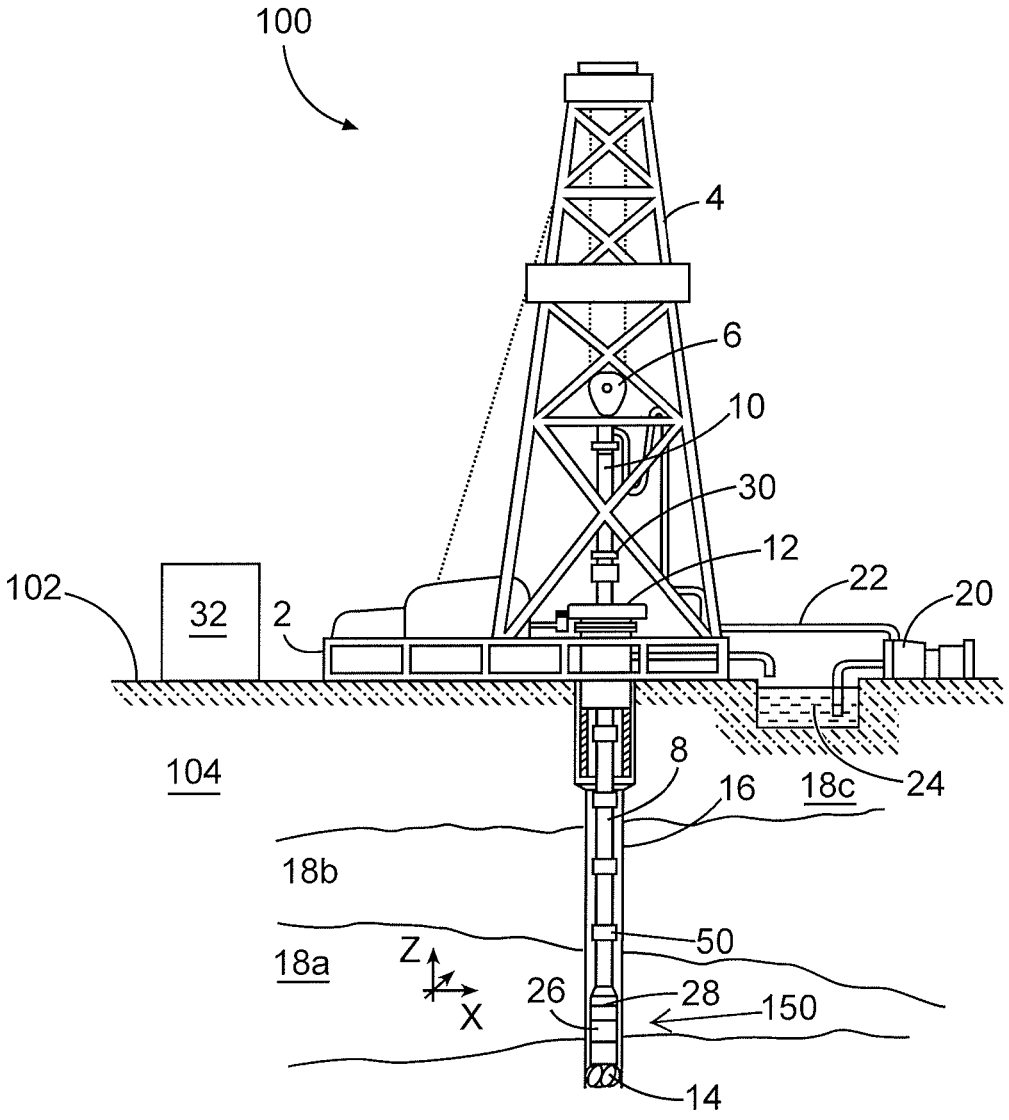
FIG. 1 is a diagram showing an example subterranean drilling system, according to aspects of the present disclosure.

While embodiments of this disclosure have been depicted and described and are defined by reference to exemplary embodiments of the disclosure, such references do not imply a limitation on the disclosure, and no such limitation is to be inferred. The subject matter disclosed is capable of considerable modification, alteration, and equivalents in form and function, as will occur to those skilled in the pertinent art and having the benefit of this disclosure. The depicted and described embodiments of this disclosure are examples only, and not exhaustive of the scope of the disclosure.

DETAILED DESCRIPTION

For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communication with external devices as well as various input and output (I/O) devices, such as a keyboard, a mouse, and a video display. The information handling system may also include one or more buses operable to transmit communications between the various hardware components. It may also include one or more interface units capable of transmitting one or more signals to a controller, actuator, or like device.

For the purposes of this disclosure, computer-readable media may include any instrumentality or aggregation of instrumentalities that may retain data and/or instructions for a period of time. Computer-readable media may include, for example, without limitation, storage media such as a direct access storage device (e.g., a hard disk drive or floppy disk drive), a sequential access storage device (e.g., a tape disk drive), compact disk, CD-ROM, DVD, RAM, ROM, electrically erasable programmable read-only memory (EEPROM), and/or flash memory; as well as communications media such wires, optical fibers, microwaves, radio waves, and other electromagnetic and/or optical carriers; and/or any combination of the foregoing.

Illustrative embodiments of the present disclosure are described in detail herein. In the interest of clarity, not all features of an actual implementation may be described in this specification. It will of course be appreciated that in the development of any such actual embodiment, numerous implementation-specific decisions are made to achieve the specific implementation goals, which will vary from one implementation to another. Moreover, it will be appreciated that such a development effort might be complex and time-consuming, but would, nevertheless, be a routine undertaking for those of ordinary skill in the art having the benefit of the present disclosure.

To facilitate a better understanding of the present disclosure, the following examples of certain embodiments are given. In no way should the following examples be read to limit, or define, the scope of the invention. Embodiments of the present disclosure may be applicable to horizontal, vertical, deviated, or otherwise nonlinear wellbores in any type of subterranean formation. Embodiments may be applicable to injection wells as well as production wells, including hydrocarbon wells. Embodiments may be implemented using a tool that is made suitable for testing, retrieval and sampling along sections of the formation. Embodiments may be implemented with tools that, for example, may be conveyed through a flow passage in tubular string or using a wireline, slickline, coiled tubing, downhole robot or the like. "Measurement-while-drilling" ("MWD") is the term generally used for measuring conditions downhole concerning the movement and location of the drilling assembly while the drilling continues. "Logging-while-drilling" ("LWD") is the term generally used for similar techniques that concentrate more on formation parameter measurement. Devices and methods in accordance with certain embodiments may be used in one or more of wireline (including wireline, slickline, and coiled tubing), downhole robot, MWD, and LWD operations.

The terms "couple," "coupled," and "couples" as used herein are intended to mean either an indirect or a direct connection. Thus, if a first device couples to a second device, that connection may be through a direct connection or through an indirect mechanical or electrical connection via other devices and connections. Similarly, the term "communicatively coupled" as used herein is intended to mean either a direct or an indirect communication connection. Such connection may be a wired or wireless connection such as, for example, Ethernet or LAN. Such wired and wireless connections are well known to those of ordinary skill in the art and will therefore not be discussed in detail herein. Thus, if a first device communicatively couples to a second device, that connection may be through a direct connection, or through an indirect communication connection via other devices and connections.

The present disclosure relates generally to downhole drilling operations and, more particularly, to a downhole linear solenoid actuator system. As will be described in detail below, example downhole linear solenoid actuator systems described herein may provide a close-loop control through which the power used to drive the actuator can be more efficiently and effectively controlled, and through which the mechanical impact and material fatigue at the actuator can be minimized. In certain embodiments, the power efficiency of the actuator system can be improved further through control configurations that facilitate the recapture of excess or stored power within solenoids of the actuator. Although the actuator system is described herein as a linear actuator system deployed in a downhole telemetry system, it is not limited to that context; rather, the close-loop control can be incorporated into other actuator types, including rotary actuators, and the actuator systems can be used in other applications.

FIG. 1 is a diagram of an illustrative subterranean drilling system 100 including a solenoid actuator drive system, according to aspects of the present disclosure. The drilling system 100 comprises a drilling platform 2 positioned at the surface 102. In the embodiment shown, the surface 102 comprises the top of a formation 104 containing one or more rock strata or layers 18*a-c*, and the drilling platform 2 may be in contact with the surface 102. In other embodiments, such as in an off-shore drilling operation, the surface 102 may be separated from the drilling platform 2 by a volume of water.

The drilling system 100 comprises a derrick 4 supported by the drilling platform 2 and having a traveling block 6 for raising and lowering a drill string 8. A kelly 10 may support the drill string 8 as it is lowered through a rotary table 12. A drill bit 14 may be coupled to the drill string 8 and driven by a downhole motor and/or rotation of the drill string 8 by the rotary table 12. As bit 14 rotates, it creates a borehole 16 that passes through one or more rock strata or layers 18*a-c*. A pump 20 may circulate drilling fluid through a feed pipe 22 to kelly 10, downhole through the interior of drill string 8, through orifices in drill bit 14, back to the surface via the annulus around drill string 8, and into a retention pit 24. The drilling fluid transports cuttings from the borehole 16 into the pit 24 and aids in maintaining integrity of the borehole 16.

The drilling system 100 may comprise a bottom hole assembly (BHA) 150 coupled to the drill string 8 near the drill bit 14. The BHA may comprise various downhole measurement tools and sensors, including LWD/MWD elements 26. Example LWD/MWD elements 26 include antenna, sensors, magnetometers, gradiometers, etc. As the bit extends the borehole 16 through the formations 18, the LWD/MWD elements 26 may collect measurements relating to the formation and the drilling assembly.

In certain embodiments, the measurements taken by the LWD/MWD elements 26 and data from other downhole tools and elements may be transmitted to the surface 102 by a telemetry system 28. In the embodiment shown, the telemetry system 28 is located within the BHA and communicably coupled to the LWD/MWD elements 26. The telemetry system 28 may transmit the data and measurements from the downhole elements as pressure pulses or waves in fluids injected into or circulated through the drilling assembly, such as drilling fluids, fracturing fluids, etc. The pressure pulses may be generated in a particular pattern, waveform, or other representation of data, an example of which may include a binary representation of data that is received and decoded at a surface receiver 30. The positive or negative pressure pulses may be received at the surface receiver 30 directly, or may be received and re-transmitted via signal repeaters 50. Such signal repeaters may, for example, be coupled to the drill string 8 at intervals, contain fluidic pulsers and receiver circuitry to receive and re-transmit corresponding pressure signals, and aide in the transmission of high frequency signals from the telemetry system 28, which would otherwise attenuate before reaching the surface receiver 30. The drilling system 100 may further comprise an information handling system 32 positioned at the surface 102 that is communicably coupled to the surface receiver 30 to receive telemetry data from the LWD/MWD elements 26 and process the telemetry data to determine certain characteristics of the formation 104.

Figure 2:
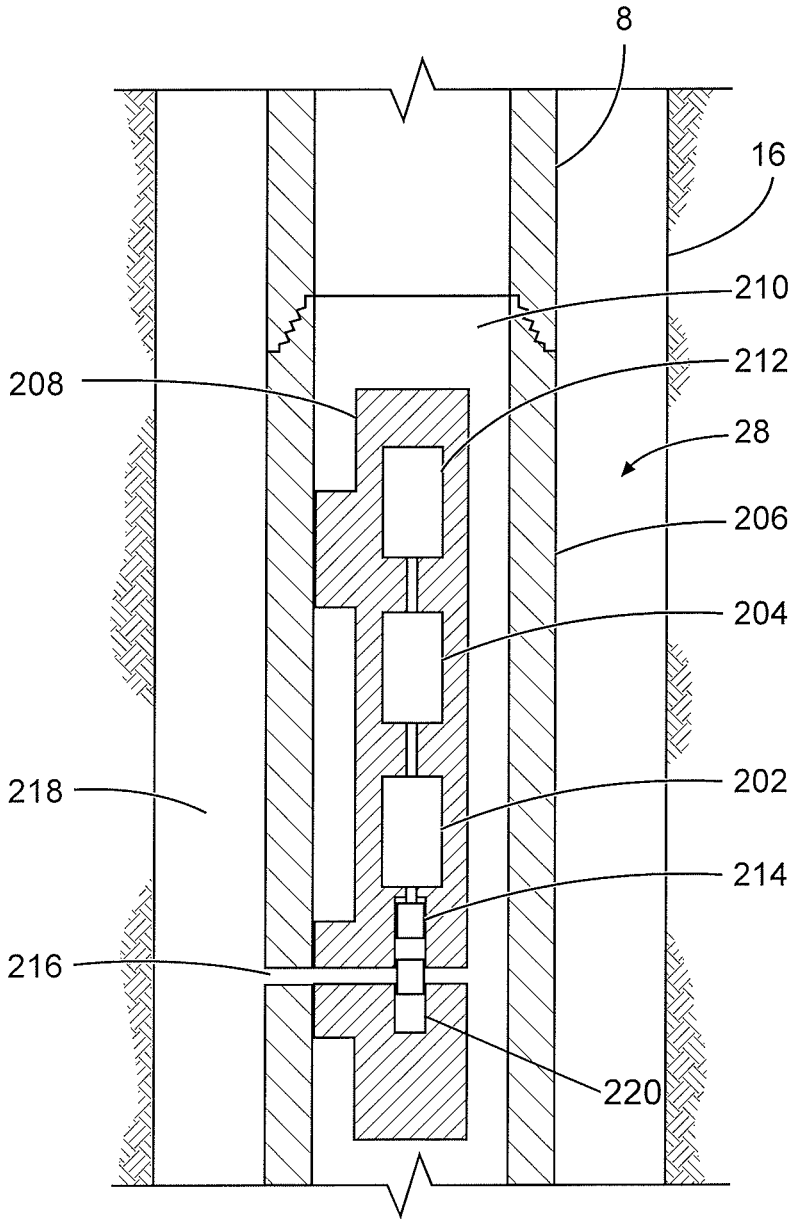
FIG. 2 is a diagram showing an example telemetry system, according to aspects of the present disclosure.

FIG. 2 is a diagram illustrating an example embodiment of the telemetry system 28, according to aspects of the present disclosure. The telemetry system 28 may comprise a linear solenoid actuator 202 and a linear solenoid actuator drive system 204 electrically coupled to the solenoid actuator 202. The linear solenoid actuator 202 and linear solenoid actuator drive system 204 may be coupled to a drill collar 206, which may be coupled to a drill string 8 when the telemetry system 28 is deployed within the borehole 16. In the embodiment shown, the actuator 202 and the drive system 204 are located within an housing 208 coupled to an interior surface of the drill collar 206 and positioned within an inner bore 210 of the drill collar 206. The housing 208 may allow drilling fluid flow through the inner bore 210 via one or more channels or annular areas between the housing 208 and the drill collar 206. In other embodiments, one of the actuator 202 and the drive system 204 may be located in the outer tubular structure of the drill collar 206 to provide greater fluid flow through the bore 210. Additionally, although one drill collar 206 is shown, multiple drill collars may be used.

The telemetry system 28 may further comprise a power supply 212 coupled to the drive system 204. The power supply 212 may comprise a bank of capacitors that are capable of storing and quickly providing the large amounts of power necessary to trigger the solenoid actuator 202. In certain embodiments, the power supply 212 may also be coupled to a power source (not shown) that provides the power stored in the capacitor bank. Example power sources include battery packs or fluid-driven electric generators. In the embodiment shown, the power supply 212 is located in the housing 208 with the drive system 204, although other locations are possible, including outside of the drill collar 206. Additionally, the power supply 212 may be incorporated into drive system 204.

The drive system 204 may selectively couple one or more solenoids of the solenoid actuator 202 to the power supply 212 to cause the actuator to move between first and second positions, which may correspond to positions of an element coupled to the solenoid actuator 202. In the embodiment shown, the solenoid actuator 202 is coupled to a gate valve 214 that is movable between fixed positions within a chamber 220 in the housing 208. These fixed positions may comprise an "open" position in which the gate valve 214 completes a fluid conduit 216 between the inner bore 210 and an annulus 218 between the drill collar 206 and the borehole 16; and a "close" position when the gate valve 214 blocks the fluid conduit 216. When the gate valve 214 moves to the "open" position from the "close" position, drilling fluid flowing within the inner bore 210 may exit into the annulus 208, causing a decrease in the drilling fluid volume within the inner bore 210 and a corresponding drop in pressure in the drilling fluid that may propagate upwards to the surface through the drill string 8. Conversely, when the gate valve 214 moves to the "close" position from the "open" position, it may cause an in the drilling fluid volume within the inner bore 210 and a corresponding increase in pressure in the drilling fluid. Accordingly, by toggling the gate valve 214 between "open" and "close" positions, the solenoid actuator 202 and drive system 204 may generate pressure pulses within the drilling fluid that are used to communicate downhole data to the surface.

Figure 3:
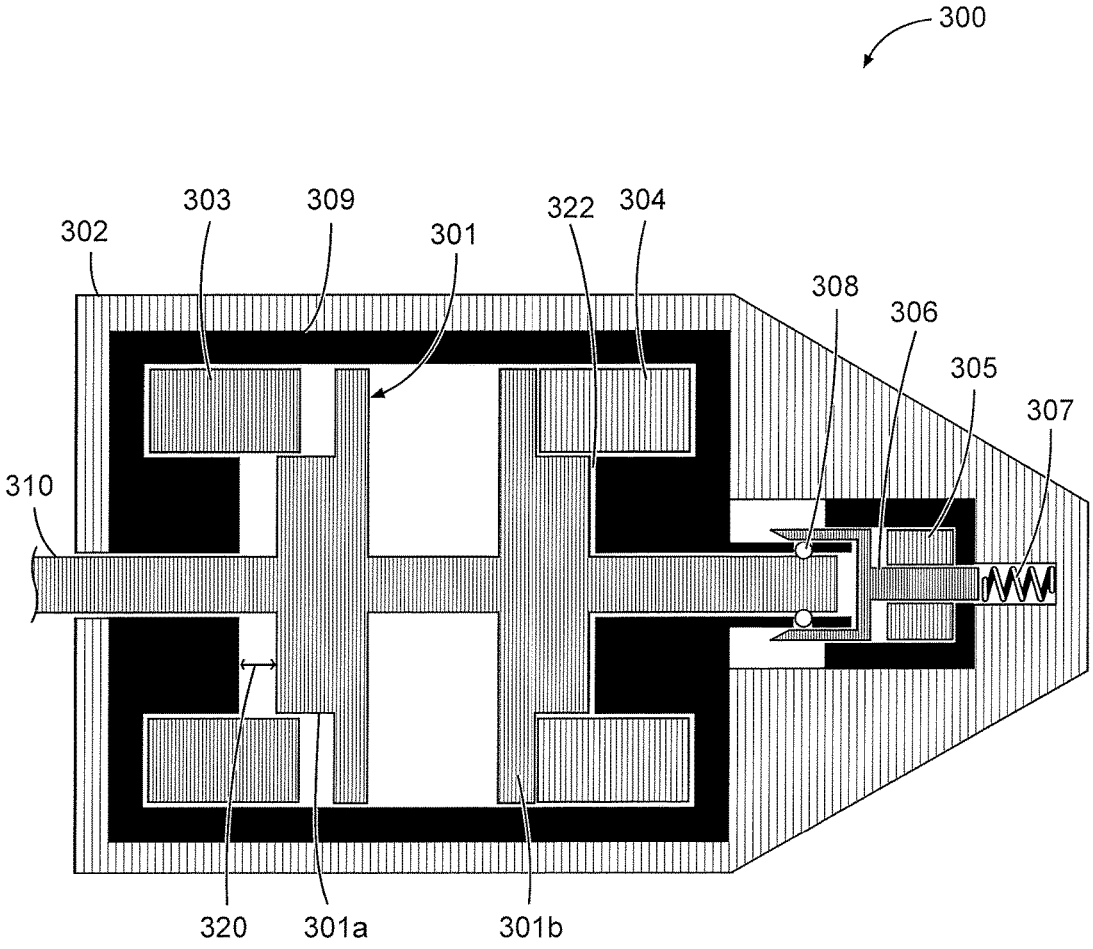
FIG. 3 is a diagram showing an example solenoid actuator, according to aspects of the present disclosure.

FIG. 3 is a diagram of an example solenoid actuator 300, according to aspects of the present disclosure. The actuator 300 may comprise a main armature 301 at least partially positioned within an outer housing 302 and an enclosing magnetic shell 309. As depicted, the actuator 300 may comprise a linear actuator characterized by linear movement by the armature 301. The enclosing magnetic shell 309 may comprise a "soft" magnetic material, characterized by low coercivity, high permeability, and high saturation magnetization, such that the materials can be magnetized but do not stay magnetized. Examples include cobalt-iron-alloys and nickel iron alloys. The actuator 300 may further comprise at least two solenoids used to move and secure the main armature 301 in first and second axial positions with respect to the outer housing 302. The armature 301 may comprise an end 310 that at least partially extends from the housing 302 to allow the armature 301 to be coupled to a movable element, such as the gate valve described above. The movable element then may be toggled between fixed axial positions with respect to the actuator 300 by causing the armature 301 to move within the housing 302.

In the embodiment shown, the actuator 300 comprises a latchable push-pull solenoid actuator with three solenoids: a first solenoid 303, a second solenoid 304, and third solenoid 305. The third solenoid 305 may be referred to as a latch solenoid and may cooperate with a latch armature 306, spring 307, and latch balls 308 to selectively mechanically secure the armature 301 in a first axial end position within the housing 302, especially when the actuator is not powered; otherwise, the main armature 301 is free to move. In certain embodiments, the latch components 305-308 can be removed to simplify the actuator. The first axial end position may be characterized by the armature 301 being shifted towards the second and third solenoids 304/305. As shown in FIG. 3, when the armature 301 is in the first axial end position and the third solenoid 305 is not energized, the spring 307 may urge the latch armature 306 towards the armature 301 such that the latch armature 306 forces the latch balls 308 into indentations in the armature 301 to prevent axial movement by the armature 301. When the third solenoid 305 is energized, it may overcome the spring force applied by the spring 307 to the latch armature 306, thereby moving the latch armature 306 away from the armature 301. This may cause the latch balls 308 to disengage with the armature and allow axial movement of the armature 301 within the housing 302.

The first and second solenoids 303/304 may comprise coils that are responsible for moving the armature 301 between first and second axial positions once the latch armature 306 and latch balls 308 are disengaged. When excited by a current, the first solenoid 303 may generate an electromagnetic field that interacts with a first portion 301*a* of the armature 301 to impart a force on the armature 301 in the direction of the first solenoid 303. This force may cause the armature 301 to move to the second axial end position, characterized by the armature 301 being shifted towards the first solenoid 303. The position of the first portion 301*a* of the armature 301 within the actuator 300 may be characterized by a distance 320 between the first portion 301*a* of the armature 301 and a portion of the magnetic shell 309 proximate the first solenoid 301, which may correspond to an "air gap" between the first portion 301*a* of the armature 301 and the portion of the magnetic shell 309 proximate the first solenoid 303. Conversely, when excited by a current, the second solenoid 304 may generate an electromagnetic field that interacts with a second portion 301*b* of the armature 301 to impart a force on the second portion 301*b* of the armature 301 in the direction of the second solenoid 304. The position of the second portion 301*b* of the armature 301 within the actuator 300 may be characterized by a distance 322 between the second portion 301*b* of the armature 301 and the portion of the magnetic shell 309 proximate the second solenoid 304, which may correspond to an "air gap" between the second portion 301*b* of the armature 301 and the portion of the magnetic shell 309 proximate the second solenoid 304.

In certain embodiments, the second axial end position of the armature 301 may correspond to an "open" position of a movable element coupled to the armature 301, and the first axial end position of the armature may correspond to a "close" position. In those embodiments, the first solenoid 303 may be referred to as an "open" solenoid that is responsible for shifting a movable element coupled to the armature 301 to the "open" position, and the second solenoid 304 may be referred to as a "close" solenoid that is responsible for shifting a movable element coupled to the armature 301 to the "close" position. Notably, the latch solenoid 305 may mechanically secure the armature 301 in the first axial end position or "close" position in the embodiment shown, but may mechanically secure the armature 301 in the "open" position in other embodiments. Likewise, the "open" and "close" function of the solenoids may change depending on the configuration of the actuator 300 and the movable element coupled to the armature 301. Additionally, the configuration of actuator 300 shown in FIG. 3 is not intended to be limiting.

Energizing the solenoids 303-305 may comprise selectively coupling the solenoids 303-305 to a power supply. In a telemetry system, energizing the solenoids 303-305 may require hundreds of watts of power because of a high differential pressure drop and the quick actuation times needed to pulse telemetry. The differential pressure drop may comprise a few thousand pounds-per-square-inch (psi) across the movable element coupled to the solenoid actuator 300, causing very high mechanical friction that demands a high drive force at the solenoids 303-305. The quick actuation time may require high drive force in order to overcome actuator inertia within a small time interval. The drive force needed at the actuator 300 positivity correlates with the power consumption at the solenoids 303-305.

Typical solenoids are not energy efficient and only achieve about 50% energy transformation from electrical power into mechanical force. The rest of the energy is converted into heat. Specifically, solenoids need to store sufficient energy to generate the required mechanical force, and this stored energy is largely converted to heat and wasted when the solenoid is deactivated. This heat can damage sensitive electronic components unless a secondary heat dissipation system, such as a heat sink, is used, or the heat generation is reduced by limiting the actuation frequency of the actuator, which can negatively affect the transmission bandwidth of a telemetry system incorporating the solenoid, for example.

Additionally, typical solenoids are energized with a current that is at or near the maximum for the available power source, in order to drive the actuator more quickly and with more force. In many instances, however, as will be described in detail below, this current causes the solenoid to operate outside of an efficient operating range, exacerbating the heat issues and inefficiently utilizing the available power. The force F generated at a single solenoid may be determined using the following equation:

$$F = K * I^2 * N^2 * A * \mu_0 * \frac{\mu_r * (\mu_r - 1)}{[l + (\mu_r - 1) * x]^2}$$

where K comprises a constant, dimensionless coefficient for the actuator design; I comprises the electric current through the solenoid coil; N comprises the number of turns in the solenoid coil; A comprises a section area of the air gap perpendicular to the magnetic flux of the coil; $\mu_0$ comprises the permeability of free space; $\mu_r$ comprises permeability of the magnet; l comprises the length of the solenoid magnetic circuit; and x comprises the air gap between the armature and the magnetic shell and represents the position of the armature. Of the variables listed above, all may be fixed based on the design of the actuator, with the exception of the relative permeability $\mu_r$, electric current I, and the air gap x. The relative permeability $\mu_r$ of the magnet is negatively inversely proportional to the current I, such that the value of the relative permeability $\mu_r$ drops to a value of 1 when the solenoid magnets are saturated at high current. Based on the above, the force F at the solenoid may be considered proportional to the electric current I and inversely proportional to the air gap x, provided the current input at the solenoid does not saturate the solenoid magnets.

Figure 4:
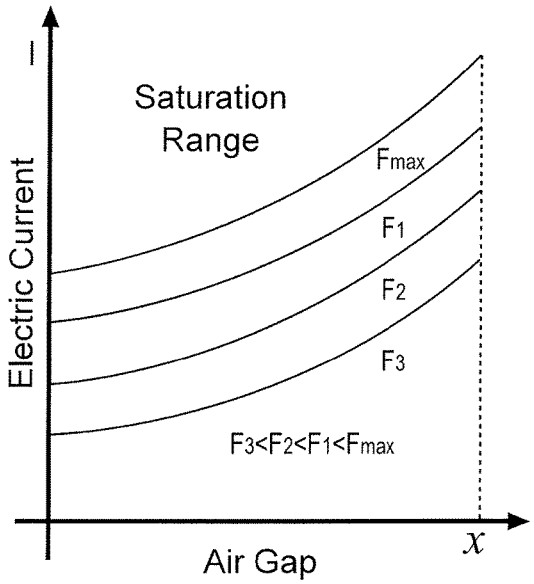
FIG. 4 is a chart illustrating an example relationship between the current and air gap to generate a force at a solenoid, according to aspects of the present disclosure.

FIG. 4 is a chart illustrating an example relationship between the current I and air gap x to generate a force F at a solenoid, according to aspects of the present disclosure. In the embodiment shown, the area between the x-axis and a curved line representing the maximum force for the solenoid $F_{max}$ represents a desirable operating mode in which the current input is insufficient to magnetically saturate the solenoid magnets. The maximum force for the solenoid $F_{max}$ may comprises a constant value based on the relationship between the electric current I and the air gap x and demonstrates the current I required to generate $F_{max}$ increases as the air gap x increases. Other force levels (e.g., $F_1$, $F_2$, $F_3$) result from a similar relationship between the electric current I and the air gap x, but with a lower current I. The area above the curve line $F_{max}$, in contrast, represents the saturation of the solenoid magnets, in which the relative permeability $\mu_r$ drops to a value of 1, and the force F generated by the solenoid drops to zero. Typical solenoid actuators lack the capability to control the input current to ensure the solenoid is not saturated during use and therefore frequently operate in this saturation region in an attempt to increase the force generated by the solenoid.

Moreover, typical solenoid actuators suffer from high impact forces when the armature contacts the magnetic shell at the first and second axial end positions. This is caused, in part, because solenoids are unidirectional in force, such that when a solenoid is actuated to move the armature to a different position, the solenoid force is able to accelerate the armature toward the desired position but unable to decelerate the armature before it contacts the magnetic shell or other stopping surface of the actuator. This contact generates mechanical impact forces that can damage the armature and actuator generally over time, particularly in downhole mud telemetry where high frequency actuation is necessary.

According to aspects of the present disclosure, a linear solenoid actuator system with close-loop control may receive one or more feedback signals from the actuator and optimize the movement of the solenoid actuator based, at least in part, on the feedback signals. This close-loop control may be used to increase the power efficiency of the solenoid actuators by ensuring the solenoids receive sufficient current to achieve maximum force without saturating the solenoid magnets, which, in turn, may reduce the power stored within the solenoid coils and the resulting the heat generated by the solenoids. Additionally, as will be described in detail below, the close-loop control may also allow for the position of the solenoid armature to be tracked in real-time or real-time, such that movement of the armature can be optimized to avoid impact forces through real-time or near real-time, parallel control of the solenoids. Mitigating the impact forces may control the material fatigue, slow down the mechanical wear-out, and increase the lifetime and reliability of the solenoid actuator.

Figure 5:
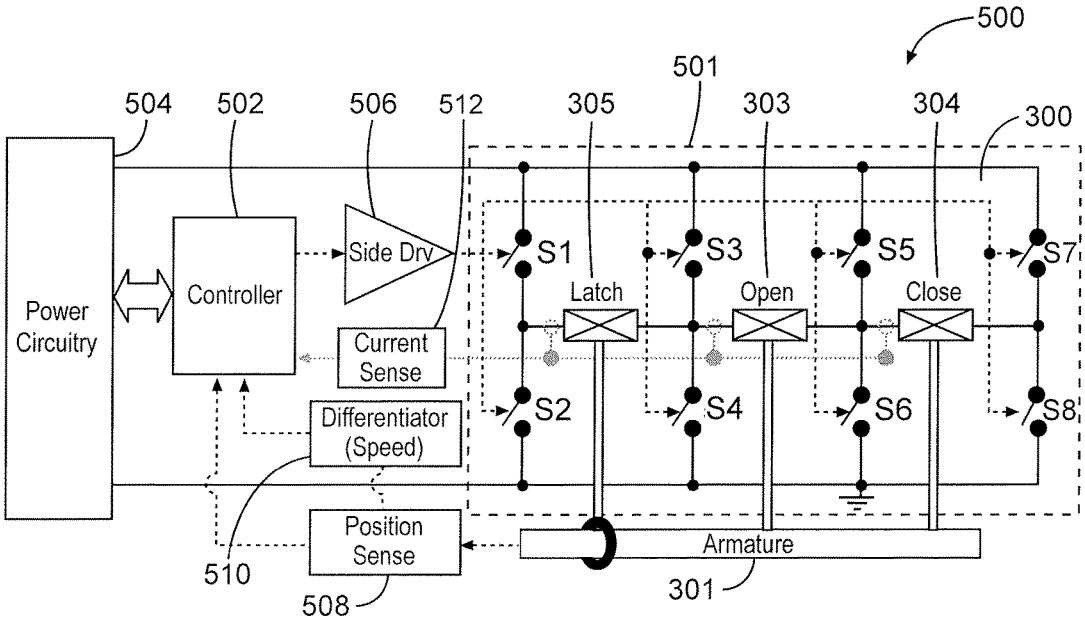
FIG. 5 is a diagram illustrating a linear actuator system, according to aspects of the present disclosure.

FIG. 5 is a diagram illustrating a linear actuator system 500 incorporating the actuator 300, according to aspects of the present disclosure. In the embodiment shown, the linear actuator system 500 comprises a controller 502 coupled to power circuitry 504. The controller 502 may comprise a processor, such as a microprocessor, microcontroller, digital signal processor (DSP), application specific integrated circuit (ASIC), or any other digital or analog circuitry configured to interpret and/or execute program instructions and/or process data. The power circuitry 504 may include a power source and/or power regulation circuitry responsive to control signals from the controller 502. The power circuitry 504 may provide voltage and current to the solenoids 303-305 of the actuator 300 through drive circuitry 501.

In the embodiment shown, the drive circuitry 501 comprises a plurality of switches S1-S8, which may be used to selectively couple the solenoids 303-305 of the actuator 300 to the power circuitry 504 respectively. The switches S1-S8 may comprise solid state switches that may be closed by the application of a control current or voltage. Examples include, but are not limited to, metal-oxide-semiconductor field-effect transistors (MOSEFT), junction gate field-effect transistors ("JEFT"), or insulated-gate bipolar transistors (IGBT). Analog or mechanical switches may also be used within the scope of this disclosure. In the embodiment shown, there are four legs between the two terminals of the power circuitry 504, each consisting of one top switch and one bottom switch connected in series. The joint of the top switch and bottom switch is connected to one terminal of one or two solenoids 303-305.

In the embodiment shown, the controller 502 may output one or more control signals to the switches S1-S8 through drive circuitry 506 to actuate one or more of the solenoids 303-305. In some embodiments, the processor may be communicatively coupled to memory, either integrated with the processor or in a separate memory device, and may be configured to interpret and/or execute program instructions and/or data stored in memory that cause the processor to generate control signals through the drive circuitry 506 to open and close the switches S1-S8 according to the predetermined sequence. If the switches S1-S8 comprise MOSFETs, for instance, a control signal generated at the controller 502 will cause the drive circuitry 506 to modify the gate voltages of the switches S1-S8 such that the select switches S1-S8 are open and closed at a given time to actuate one or more of the solenoids.

In the embodiment shown, each of solenoids 303-305 can be actuated by closing one top and one bottom switches which belong to the different two legs connected to the solenoid. For example, latch solenoid 305 can be actuated by closing the top switch S1 and the bottom switch S4, or the top switch S3 and the bottom switch S2. Once a solenoid is actuated, it can be disconnected from the power circuitry 504 by closing either the two top switches or two bottom switches of the two connected legs, and opening the other switches of those legs, which allows the solenoid to remain actuated due to its stored energy. To de-energize or de-actuate a solenoid, the two switches of the connected legs which are opposite to the switches used in the actuation may be closed, allowing the stored energy to be recaptured at the power circuitry 504 or reused to actuate the next solenoid. For example, if latch solenoid 305 has been actuated by closing switches S1 and S4, it can be de-energized by closing the bottom switch S2 and the top switch S3, opposite to the top switch S1 and the bottom switch S4, respectively. Notably, recapturing and reusing the stored energy may reduce the heat generated by the solenoid actuator, reduce the need for a heat sink within the drive system, reduce the total power consumption so that a smaller power supply can be used, and potentially increase the frequency of the solenoid actuator, which may increase the transmission capability of a telemetry system incorporating the solenoid drive system.

According to aspects of the present disclosure, the controller 502 may receive at least one feedback signal corresponding to a present condition of the actuator 300. The present condition of the actuator 300 may include, for example, a present condition of at least one of the solenoids 303-305 and a present condition of the armature 301. In the embodiment shown, the feedback signal comprises a signal corresponding to the position of the armature 301 within the actuator 300 and a signal corresponding to the current level being provided to the solenoids 303-305 from the power circuitry 504. The position signal may be received at the controller 502 from a position sensor 508 coupled to the armature 301 of the actuator 300. Example position sensors include, but are not limited to, hall sensors, capacitive sensors, inductive sensors, encoders, etc. The output of the sensor 508 may be received at the controller 502 and at a differentiator 510, which may determine and output to the controller 502 the speed of the armature 301. The current signal may be received at the controller 502 from a current sensor 512 coupled to the power circuitry 504, examples of which includes Hall effect sensors, magnetostrictive effect sensors, and any other sensors that would be appreciated by one of ordinary skill in the art in view of this disclosure.

According to aspects of the present disclosure, the controller 502 may generate one or more controls signals based, at least in part, on the received feedback signals. Those control signals may include, for example, control signals to the drive circuitry 506 to affect the charge/discharge levels of the solenoids 303-305 by altering the states of at least some of the switches, which may include selectively opening and closing some or all of the switches. In certain embodiments, the control signal from the controller 502 may be generated based, at least in part, on a pre-determined relationship between the air gaps in the actuator 300 and the current level within the solenoids 303 and 304. That predetermined relationship may include, for example, relationships similar to the one illustrated above with reference to FIG. 4.

In certain embodiments, the controller 502 may include a pre-calculated look-up table or other algorithm through which the controller 502 may generate and output control signals based on the received feedback signals. For example, a look-up table may be generated for a specific solenoid design based on the maximum force for the solenoid $F_{max}$, which may correspond to the fastest movement of the armature shaft from one position to another within the solenoid. The look-up table may comprise entries that associate discrete air-gap values with corresponding target control currents I determined using a chart similar to the one shown in FIG. 4. In certain embodiments, the controller 502 may receive a feedback signal in the form of a position signal of the armature 301, and the controller 502 may calculate the air gap x based on the position signal and identify the target coil current I from the look-up table. The controller 502 may then compare the actual coil current I, which may be identified through a current level feedback signal, to the target coil current I, and generate the necessary control signal if the two values differ. Alternatively, the look-up table may include pre-determined control signals associated with the target control current I that can be selected and output by the controller automatically or as necessary to alter the functionality of the solenoid. Alternatively, or in addition, the position signal corresponding to the current position of the armature 301 may be compared by the controller 502 to a desired position of the armature 301 to determine which of the solenoid coils to charge and/or discharge during the movement of the armature shaft.

Figure 6:
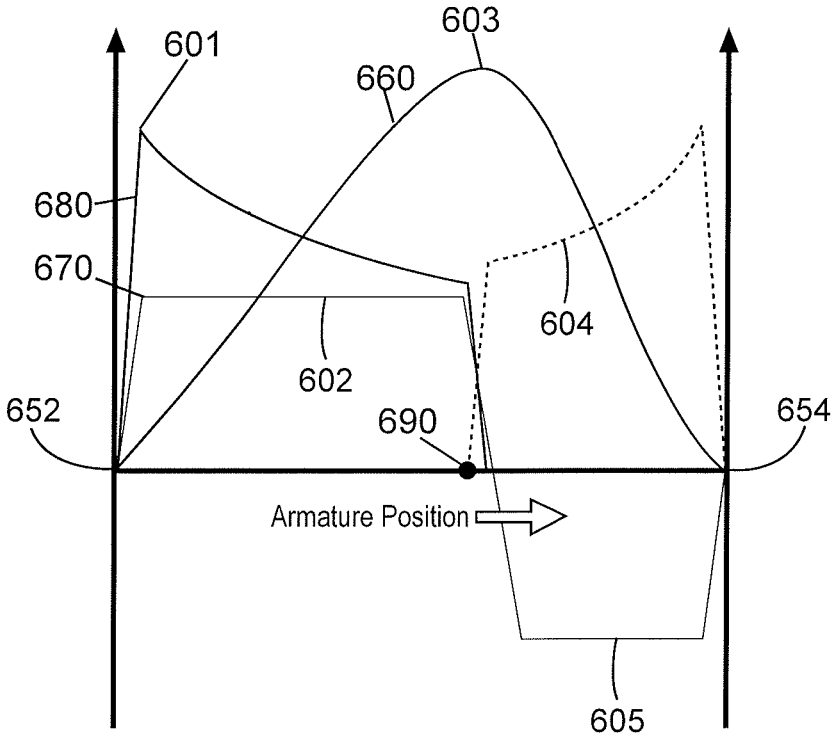
FIG. 6 is a chart illustrating the speed, force, and current of an actuator generated using an example downhole solenoid linear actuator system, according to aspects of the present disclosure.

FIG. 6 is a chart illustrating the speed 660, force 670, and current 680 of an actuator of an example downhole solenoid linear actuator system as an associated armature is moved from a "close" position 652 corresponding to a close solenoid to an "open" position 654 corresponding to an open solenoid coil, according to aspects of the present disclosure. To begin moving the armature toward the open position 654, a controller of the downhole solenoid linear actuator system may first energize the open solenoid, as indicated by spike 601 in current 680. The open solenoid is energized until the force 670 reaches its maximum value 602 at the open solenoid. In certain telemetry embodiments, where high frequency actuation may be necessary, the open solenoid may be energized as quickly as possible until the maximum force 602 is generated. As described above, the current 680 input to the open solenoid may be determined based, at least in part, on a position of the armature and a look-up table at the controller. Specifically, as the force 670 acts on the armature, the armature accelerates toward the open solenoid, which causes a corresponding decrease in the size of the air gap between the armature and the open solenoid, which in turn reduces the input current necessary to produce the maximum force 602.

In the embodiment shown, the maximum force 602 is maintained until the speed 660 of the armature reaches its maximum 603 at a pre-determined position 690. Once the armature reaches its maximum speed, the armature may be decelerated, such that the speed 660 of the armature drops to substantially zero as it reaches the open position 654. This may ensures that the armature is not subject to impact forces from hitting the open solenoid when it reaches the open position 654. In the embodiment shown, the armature is decelerated by de-energizing the open solenoid, as indicated by the current 680 dropping to zero, and energizing the close solenoid until, as indicated by current portion 604, the close solenoid exerts its maximum force 605 on the armature in the direction opposite the movement of the armature. In certain embodiments, it may be necessary to energize the close solenoid as quickly as possible until the maximum force 605 is exerted on the armature. The current 680 input to the close solenoid may be controlled by the controller using a look-up table, as described above, based on the feedback signal indicating the position of the armature. As can be seen, the curvature of the current used to energize the close solenoid is opposite the shape of the current used to energize the open solenoid, because the air gap between the armature and the close solenoid is increasing as the armature moves to the open solenoid, such that the current used to energize the close solenoid must be increased as the armature moves to maintain the maximum force 605. As the armature nears the open position 654, the close solenoid may be de-energized, as indicated by the current 680 dropping to zero, so that the armature will remain at the open position 654. Generally, the process may be reversed to return the armature to the close position 652.

The controller of the actuator system correspond to FIG. 6 may determine when to energize and de-energize the open and close solenoids based, at least in part, on a feedback signal containing the position of the armature and/or the speed of the armature. The controller may determine, for example, that the armature needs to be moved to the open position 654 by identifying that the armature is presently in the close position 652, and in response to that determination, may generate one or more control signals to the power supply/drive circuitry to provide the current 601 to the open solenoid. Similarly, the controller may determine that the armature needs to be decelerated by identifying through the feedback signal when the armature has reached the position 690, or when the armature has reached its maximum speed 603, and in response to that determination, may generate one or more control signals to the power supply/drive circuitry to disconnect the open solenoid from the power supply and to provide the current 670 to the close solenoid. Likewise, the controller may determine when the armature is nearing the open position based, at least in part, on the feedback signal, and in response to the determination, may generate one or more control signals to the power supply/drive circuitry to disconnect the close solenoid.

An example apparatus incorporating aspects of the present disclosure may include a solenoid actuator with a solenoid coil and a corresponding solenoid armature. A plurality of switches may be coupled to the solenoid coil. A controller may be electrically coupled to the plurality of switches, the controller having a processor and a memory device coupled to the processor. The memory device may contain a set of instructions that, when executed by the processor cause the processor to receive a feedback signal corresponding to a condition of at least one of the solenoid coil and the solenoid armature; and generate a control signal to alter the state of at least one of the plurality of switches based, at least in part, on the received feedback signal.

In one or more embodiments described in the preceding paragraph, the apparatus further comprises at least one of a sensor coupled to the solenoid armature and a sensor coupled to at least one of the plurality of switches. In one or more embodiments, the sensor may be coupled to the solenoid armature comprises at least one of a position sensor, a capacitive sensor, an inductive sensor, and an encoders; and the sensor may be coupled to at least one of the plurality of switches comprises at least one of a Hall effect sensor and a magnetostrictive effect sensor.

In one or more embodiments described in the preceding two paragraphs, the feedback signal corresponding to the condition of at least one of the solenoid coil and the solenoid armature may comprise at least one of a signal corresponding to a position of the armature and a signal corresponding to a present current level of the solenoid coil.

In one or more embodiments described in the preceding paragraph, the set of instructions that cause the processor to generate the control signal to alter the state of at least one of the plurality of switches based, at least in part, on the received feedback signal further cause the processor to calculate an air gap corresponding to the position of the armature. In certain embodiments, the set of instructions that cause the processor to generate the control signal to alter the state of at least one of the plurality of switches based, at least in part, on the received feedback signal further cause the processor to determine a target current level of the solenoid coil based, at least in part, on the calculated air gap. In certain embodiments, the set of instructions that cause the processor to determine the target current level of the solenoid coil based, at least in part, on the calculated air gap further causes the processor to determine the target current level using a look-up table. In certain embodiments, the set of instructions that cause the processor to generate the control signal to alter the state of at least one of the plurality of switches based, at least in part, on the received feedback signal further cause the processor to compare the target current level to the present current level and generate the control signal based, at least in part, on the results of the comparison.

In one or more embodiments described in the preceding two paragraphs, the apparatus further comprises another solenoid coil and corresponding solenoid armature; the another solenoid coil is coupled to at least some of the plurality of switches; and the set of instructions that cause the processor to generate the control signal to alter the state of at least one of the plurality of switches based, at least in part, on the received feedback signal further cause the processor to generate the control signal to alter the state of at least one of the plurality of switches to charge one of the solenoid coil and the another solenoid coil and discharge the other one of the solenoid coil and the another solenoid coil based, at least in part, on the signal corresponding to the position of at least one of the armature and the another armature. In certain embodiments, the solenoid actuator comprises a linear actuator.

An example method incorporating aspects of the present disclosure may include generating a control signal to at least one of a plurality of switches coupled to a solenoid coil of a solenoid actuator, wherein the solenoid actuator comprises a solenoid armature corresponding to the solenoid coil. A feedback signal corresponding to a condition of at least one of the solenoid coil and the solenoid armature may be received. Another control signal may be generated to alter the state of at least one of the plurality of switches based, at least in part, on the received feedback signal.

In one or more embodiments described in the preceding paragraph, the solenoid actuator further comprises at least one of a sensor coupled to the solenoid armature and a sensor coupled to at least one of the plurality of switches. In certain embodiments, the sensor coupled to the solenoid armature comprises at least one of a position sensor, a capacitive sensor, an inductive sensor, and an encoders; and the sensor coupled to at least one of the plurality of switches comprises at least one of a Hall effect sensor and a magnetostrictive effect sensor.

In one or more embodiments described in the preceding two paragraphs, receiving the feedback signal corresponding to the condition of at least one of the solenoid coil and the solenoid armature further comprises receiving at least one of a signal corresponding to a position of the armature and a signal corresponding to a present current level of the solenoid coil. In certain embodiments, generating the another control signal to alter the state of at least one of the plurality of switches based, at least in part, on the received feedback signal further comprises calculating an air gap corresponding to the position of the armature. In certain embodiments, generating the another control signal to alter the state of at least one of the plurality of switches based, at least in part, on the received feedback signal further comprises determining a target current level of the solenoid coil based, at least in part, on the calculated air gap. In certain embodiments, determining the target current level of the solenoid coil based, at least in part, on the calculated air gap further comprises determining the target current level using a look-up table. In certain embodiments, generating the another control signal to alter the state of at least one of the plurality of switches based, at least in part, on the received feedback signal further comprises comparing the target current level to the present current level and generate the control signal based, at least in part, on the results of the comparison.

In one or more embodiments described in the preceding two paragraphs, the solenoid actuator further comprises another solenoid coil and corresponding solenoid armature; the another solenoid coil is coupled to at least some of the plurality of switches; and generating the another control signal to alter the state of at least one of the plurality of switches based, at least in part, on the received feedback signal further comprises generating the control signal to alter the state of at least one of the plurality of switches to charge one of the solenoid coil and the another solenoid coil and discharge the other one of the solenoid coil and the another solenoid coil based, at least in part, on the signal corresponding to the position of at least one of the armature and the another armature. In certain embodiments, The method of claim 19, wherein the solenoid actuator comprises a linear actuator.

Therefore, the present disclosure is well adapted to attain the ends and advantages mentioned as well as those that are inherent therein. The particular embodiments disclosed above are illustrative only, as the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered or modified and all such variations are considered within the scope and spirit of the present disclosure. Also, the terms in the claims have their plain, ordinary meaning unless otherwise explicitly and clearly defined by the patentee. The indefinite articles "a" or "an," as used in the claims, are defined herein to mean one or more than one of the element that it introduces.

What is claimed is:

1. An apparatus, comprising:

a solenoid actuator with a solenoid coil and a corresponding solenoid armature, wherein the solenoid armature is at least partially positioned within a magnetic shell;

a plurality of switches coupled to the solenoid coil;

a controller electrically coupled to the plurality of switches, the controller comprising a processor and a memory device coupled to the processor, the memory device containing a set of instructions that, when executed by the processor cause the processor to receive a feedback signal corresponding to a condition of at least one of the solenoid coil and the solenoid armature; and generate a control signal to alter the state of at least one of the plurality of switches based, at least in part, on the received feedback signal, wherein the feedback signal corresponding to the condition of the at least one of the solenoid coil and the solenoid armature comprises a signal corresponding to a position of the armature, wherein the position of the armature is based on a distance between the armature and the magnetic shell.

2. The apparatus of claim 1, wherein the apparatus further comprises at least one of a sensor coupled to the solenoid armature and a sensor coupled to at least one of the plurality of switches.

3. The apparatus of claim 2, wherein the sensor coupled to the solenoid armature comprises at least one of a position sensor, a capacitive sensor, an inductive sensor, and an encoder; and the sensor coupled to at least one of the plurality of switches comprises at least one of a Hall effect sensor and a magnetostrictive effect sensor.

4. The apparatus of any one of claim 1, wherein the feedback signal corresponding to the condition of at least one of the solenoid coil and the solenoid armature comprises a signal corresponding to a present current level of the solenoid coil.

5. The apparatus of claim 4, wherein the set of instructions that cause the processor to generate the control signal to alter the state of at least one of the plurality of switches based, at least in part, on the received feedback signal further cause the processor to calculate an air gap corresponding to the position of the armature.

6. The apparatus of claim 5, wherein the set of instructions that cause the processor to generate the control signal to alter the state of at least one of the plurality of switches based, at least in part, on the received feedback signal further cause the processor to determine a target current level of the solenoid coil based, at least in part, on the calculated air gap.

7. The apparatus of claim 6, wherein the set of instructions that cause the processor to determine the target current level of the solenoid coil based, at least in part, on the calculated air gap further causes the processor to determine the target current level using a look-up table.

8. The apparatus of claim 6, wherein the set of instructions that cause the processor to generate the control signal to alter the state of at least one of the plurality of switches based, at least in part, on the received feedback signal further cause the processor to compare the target current level to the present current level and generate the control signal based, at least in part, on the results of the comparison.

9. The apparatus of claim 4, wherein the apparatus further comprises another solenoid coil and corresponding solenoid armature;

the another solenoid coil is coupled to at least some of the plurality of switches; and the set of instructions that cause the processor to generate the control signal to alter the state of at least one of the plurality of switches based, at least in part, on the received feedback signal further cause the processor to generate the control signal to alter the state of at least one of the plurality of switches to charge one of the solenoid coil and the another solenoid coil and discharge the other one of the solenoid coil and the another solenoid coil based, at least in part, on the signal corresponding to the position of at least one of the armature and the another armature.

10. The apparatus of claim 9, wherein the solenoid actuator comprises a linear actuator.

11. A method, comprising:

generating a control signal to at least one of a plurality of switches coupled to a solenoid coil of a solenoid actuator, wherein the solenoid actuator comprises a solenoid armature corresponding to the solenoid coil, and wherein the solenoid armature is at least partially positioned within a magnetic shell;

receiving a feedback signal corresponding to a condition of at least one of the solenoid coil and the solenoid armature; and generating another control signal to alter the state of at least one of the plurality of switches based, at least in part, on the received feedback signal, wherein the feedback signal corresponding to the condition of at least one of the solenoid coil and the solenoid armature comprises a signal corresponding to a position of the armature, wherein the position of the armature is based on a distance between the armature and the magnetic shell.

12. The method of claim 11, wherein the solenoid actuator further comprises at least one of a sensor coupled to the solenoid armature and a sensor coupled to at least one of the plurality of switches.

13. The method of claim 12, wherein the sensor coupled to the solenoid armature comprises at least one of a position sensor, a capacitive sensor, an inductive sensor, and an encoders; and the sensor coupled to at least one of the plurality of switches comprises at least one of a Hall effect sensor and a magnetostrictive effect sensor.

14. The method of any one of claim 11, wherein receiving the feedback signal corresponding to the condition of at least one of the solenoid coil and the solenoid armature further comprises receiving at least one of a signal corresponding to a present current level of the solenoid coil.

15. The method of claim 14, wherein generating the another control signal to alter the state of at least one of the plurality of switches based, at least in part, on the received feedback signal further comprises calculating an air gap corresponding to the position of the armature.

16. The method of claim 15, wherein generating the another control signal to alter the state of at least one of the plurality of switches based, at least in part, on the received feedback signal further comprises determining a target current level of the solenoid coil based, at least in part, on the calculated air gap.

17. The method of claim 16, wherein determining the target current level of the solenoid coil based, at least in part, on the calculated air gap further comprises determining the target current level using a look-up table.

18. The method of claim 16, wherein generating the another control signal to alter the state of at least one of the plurality of switches based, at least in part, on the received feedback signal further comprises comparing the target current level to the present current level and generate the control signal based, at least in part, on the results of the comparison.

19. The method of claim 14, wherein the solenoid actuator further comprises another solenoid coil and corresponding solenoid armature;

the another solenoid coil is coupled to at least some of the plurality of switches; and generating the another control signal to alter the state of at least one of the plurality of switches based, at least in part, on the received feedback signal further comprises generating the control signal to alter the state of at least one of the plurality of switches to charge one of the solenoid coil and the another solenoid coil and discharge the other one of the solenoid coil and the another solenoid coil based, at least in part, on the signal corresponding to the position of at least one of the armature and the another armature.

20. The method of claim 19, wherein the solenoid actuator comprises a linear actuator.

* * * * *